US006220288B1

(12) United States Patent
Sandau et al.

(10) Patent No.: US 6,220,288 B1
(45) Date of Patent: Apr. 24, 2001

(54) ELECTROHYDRAULIC CONTROL DEVICE

(75) Inventors: Hartmut Sandau, deceased, late of Schwieberdingen, by Roswitha Sandau, Christine Sandau legal representatives; Werner Schumacher, Asperg; Holger Lueues, Bietigheim-Bissingen, all of (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/125,871

(22) PCT Filed: Jun. 6, 1997

(86) PCT No.: PCT/DE97/01145

§ 371 Date: Aug. 26, 1998

§ 102(e) Date: Aug. 26, 1998

(87) PCT Pub. No.: WO98/07611

PCT Pub. Date: Feb. 26, 1998

(30) Foreign Application Priority Data

Aug. 24, 1996 (DE) ..... 196 34 319

(51) Int. Cl.[7] ..... F15B 13/044

(52) U.S. Cl. ..... 137/596.2; 91/450; 91/465; 137/596.17

(58) Field of Search ..... 91/450, 465; 137/596.17, 137/596.2

(56) References Cited

U.S. PATENT DOCUMENTS

| | | | | |
|---|---|---|---|---|
| 3,667,722 | | 6/1972 | Katz et al. . | |
| 5,328,148 | * | 7/1994 | Sandau | 251/30.04 |
| 5,799,485 | * | 9/1998 | Sandau | 91/448 X |

OTHER PUBLICATIONS

Copy of Robert Bosch GMBH Document "R. 29044", Publication Date Unknown.

* cited by examiner

*Primary Examiner*—Gerald A. Michalsky
(74) *Attorney, Agent, or Firm*—Michael J. Striker

(57) ABSTRACT

An electro-hydraulic control device (10, 60) for a hydraulic servo motor for controlling a volume flow is proposed, which is embodied as a 4/2 valve module. A blocking valve in accordance with seat valve technology between a motor connection (B) and a return flow (R) form a lowering element (11), while the associated unblocking member (44) is designed as a longitudinal slide (45), which controls the connection between an inflow connection (P) and a motor connection (A) and is actuated by a proportional magnet (16). After unblocking the blocking valve, its seat valve body (23) is mechanically taken along by the longitudinal slide (45), and the two volume flows are proportionally controlled via the lowering element (11) and the lifting element (12), so that a large switching capacity is achieved along with a construction with few leaks.

17 Claims, 3 Drawing Sheets

ELECTROHYDRAULIC CONTROL DEVICE

BACKGROUND OF THE INVENTION

1. Field of the Invention

The invention is based on an electro-hydraulic control device and, more particularly, to an electro-hydraulic control device for a hydraulic servo motor for controlling a volume flow, having a blocking valve arranged in a housing, whose movable seat valve body is inserted into a connection between a motor chamber and a return flow chamber for securing the motor chamber, and having a proportional magnet with an armature-actuated tappet for actuating the blocking valve.

2. Prior Art

This type of electro-hydraulic control device is already known from U.S. Pat. No. 3,667,722, by means of which a delicate proportional volume control is possible. The check valve protecting the hydraulic servo motor with its load is here designed as a pilot seat valve, so that the leakage is as small as possible. This control device can be used as a lowering brake valve, wherein the actuating forces are as low as possible and therefore the proportional magnet can be made small. It is disadvantageous in connection with this control device that only a 2/3 valve function can be represented, wherein no additional valve functions can be performed by the lowering element designed in accordance with seat valve techniques. In order to keep the actuating forces low here, a one-armed lever, with which a force transfer is performed, is placed between the proportional magnet and the actual seat valve. The force for actuating the check valve is transmitted by an unblocking member, which is made in a pin shape and with a narrow diameter, so that it cannot take on additional functions. The volume flow appearing during the lowering of a load is here only controlled by a valve cone at a seat valve body, so that the flow forces appearing particularly at high loads can considerably interfere with the proportional work functioning of the check valve. Therefore the seat valve body, which here is controlled purely hydraulically, easily tends to oscillate, particularly when pulling loads or changing load directions occur. The ball in the seat valve body, which operates as a pilot member, does not have pressure compensation. In addition, the control device is relatively elaborately constructed, to which the transmitting lever and the valve case for the check valve in particular contribute.

Furthermore, an electro-hydraulic control device had already been proposed in an older patent application, P 195 22 746.8, which operates with 4/2 valve modules. In this case two such 4/2 valve modules with additional non-return valves are arranged in a circuit in such a way that a control valve for a double-acting servo motor results. A seat valve element and a slide element are combined with each other in each 4/2 valve module in such a way, that they have a common, one-piece control member. In this not prepublished control device, this one-piece construction of the control member in the 4/2 valve module leads to a relatively elaborate construction; in addition, difficulties arise in this 4/2 valve module because of close longitudinal tolerances when adjusting the control edges to each other. Form and play tolerances are harder to control with relatively long slides in particular. Furthermore, stepped slides in stepped bores with little play make high demands in respect to deviations from running true; in addition, the stepped slides cannot be ground centerless.

SUMMARY OF THE INVENTION

It is an object of the present invention to provide an improved electro-hydraulic control device of the above-described type, especially for a hydraulic servo motor for controlling a volume flow, which does not have the above-described disadvantages.

According to the invention the electro-hydraulic control device for a hydraulic servo motor for controlling a volume flow, has a blocking valve arranged in a housing, whose movable seat valve body is inserted into a connection between a first motor chamber and a return flow chamber for securing the motor chamber, and has a proportional magnet with an armature-actuated tappet for actuating the blocking valve, and has a longitudinally movable unblocking member, which is separated from the blocking valve and slidingly guided in the housing, which is inserted into the operation connection between the tappet of the proportional magnet and the blocking valve, and is characterized in that, the unblocking member and the tappet of the proportional magnet are arranged coaxially with respect to each other and the unblocking member is embodied as a longitudinal slide which, with one control edge, controls the connection between an inflow chamber and a second motor chamber, wherein the latter is arranged in the slide bore receiving the longitudinal slide next to the return flow chamber and that the longitudinal slide essentially has the same exterior diameter as the seat valve body, and that upon actuation by the proportional magnet both connections are opened or closed in the same direction.

In contrast hereto, the electro-hydraulic control device of the invention has the advantage, that with a simple construction it represents a 4/2 valve function, wherein a lowering element designed in accordance with seat valve technology keeps the leakage as small as possible. The control device can be used in many ways because of its 4/2 function, and in addition is constructed in a cost-efficient and compact way. The control device can be employed as a lowering brake valve, by means of which a sensitive proportional volume control is possible. Because of the two-piece construction, a control edge adjustment can be realized in a simple manner by the length adaptation of the transfer edges.

Advantageous further developments and improvements of the electro-hydraulic control device possible by means of the measures noted in the dependent claims and the following disclosure.

In a preferred embodiment of the invention the seat valve body and the longitudinal slide are guided in a continuous slide bore, particularly with a generally uniform diameter, in which, lying next to each other and arranged spaced from each other in a direction toward the proportional magnet, four chambers are provided for the first motor connection, the return flow connection, the second motor connection and the inflow connection. A valve seat, in particular with a smaller diameter in comparison with the slide bore, which is associated with the seat valve body, is arranged in this slide bore between the first motor chamber and the return flow chamber. It is possible to achieve a particularly advantageous compact structure which, with its four working chambers, is assembled in a particularly space-saving manner.

Other advantageous embodiments are possible in which the blocking valve is a pilot valve, whose seat valve body receives a pilot member, which can be unblocked by the longitudinal slide via a transfer bolt. Preferably the pilot member is a pressure-compensated pilot cone. This makes it possible to achieve small actuation forces by hydraulic unblocking, so that proportional magnets of small size can be employed.

In another preferred embodiment an axially oriented extension, which protrudes into the return flow chamber, has a transfer bolt on its end, and a transfer shoulder associated with the seat valve body is arranged on the extension. The extension is provided between the longitudinal slide and the seat valve body on one of the two components, preferably on the longitudinal slide on its side facing away from the proportional magnet. In this embodiment the seat valve body and the control slide can cooperate like a mutual, one-piece control member, wherein the control slide takes the seat valve body along mechanically, as is the case in connection with a conventional control device. In this case pulling loads in particular can be better managed.

A particularly simple and cost-effective embodiment, which is mainly suitable for small regulating directional control valves with relatively low switching capacity, results when the longitudinal slide can be directly actuated by the armature tappet, and is pressure-compensated with respect to the pressures in the inflow chamber, the second motor chamber and the return flow chamber.

Other embodiments may be used in a wide diversity of possible applications. In one of these embodiments a piston section supporting the control edge on the longitudinal slide has an auxiliary control edge which, in an initial position, relieves the second motor chamber into the return flow chamber, and in an operating position blocks this connection. In another embodiment the seat valve body in the slide bore delimits a pressure chamber, in which a spring is arranged which, together with the pressure acting on the front face of the latter, charges the seal valve body in the direction toward the blocking position, in which it rests with its seat edge, which has a smaller diameter in comparison with the diameter of the slide bore, against the valve seat fixed in place on the housing, and in the process encloses an annular chamber, which is located upstream of the valve seat and delimited by the seat valve body, and whose pressure charges the seat valve body in the opening direction via an associated annular surface, and which annular chamber is separated from the first motor chamber by means of the control edge, on whose pressure charges the seat valve body in the opening direction via an associated annular surface, and which annular chamber is separated from the first motor chamber by means of the control edge, on which precision regulating recesses are arranged, particularly located on the circumference of the seat valve body.

In another preferred embodiment the longitudinal slide can be actuated by the proportional magnet via a hydraulic sequence control device. Thus hydraulic amplification is provided for actuating the control slide so that the control device is suitable for regulating directional control valves for higher switching capacities.

This hydraulic amplification can be achieved by a particular simple, cost-effective and compact construction in an embodiment in which the sequence control device has a pilot slide, which can be actuated by the proportional magnet against a regulating spring and is arranged centered on the longitudinal slide and slidingly guided. Preferably an unblocking piston is arranged in the longitudinal slide, which is used for unblocking the blocking valve in the lowering element by means of a transfer bolt, which is slidingly guided in the longitudinal slide. The pilot slide and the unblocking piston preferably have the same exterior diameter and are slidingly guided in the longitudinal slide in the same longitudinal bore. The control oil flow, which is used for the hydraulic sequence control device and is conducted from the inflow chamber to the return flow chamber, is advantageously conducted over a throttle arranged in the unblocking piston.

A characteristic valve curve can be set when, with its front face facing the proportional magnet, the longitudinal slide delimits a control chamber in the slide bore, which chamber receives an adjusting screw, against which the regulating spring is supported, fixed in place on the housing, which charges the pilot slide against the magnetic force.

BRIEF DESCRIPTION OF THE DRAWING

Two exemplary embodiments of the invention are represented in the drawings and will be explained in more detail in the following description.

DESCRIPTION OF THE EXEMPLARY EMBODIMENTS

Figure 1:
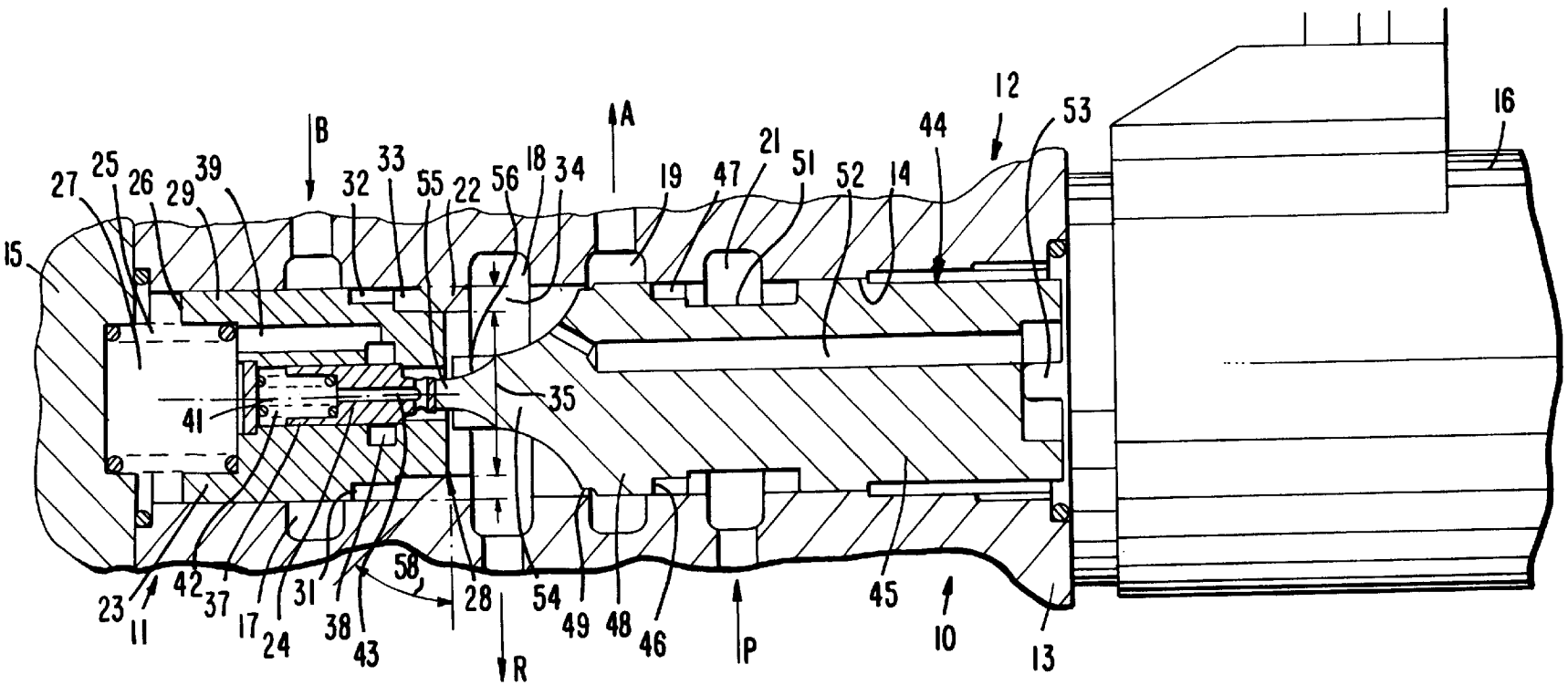
FIG. 1 shows a longitudinal section through a first control device in a simplified representation.

FIG. 1 shows a longitudinal section through a first electro-hydraulic control device 10 in a simplified representation, such as can be used for a hydraulic servo motor for the control of volume flows. The control device 10 is embodied as a 4/2 valve module, wherein a lowering element 11 produced in accordance with seat valve technology and a lifting element 12 produced in accordance with slide technology are combined with each other.

In a housing 13, the control device 10 has a continuous slide bore 14, which is closed at its front faces by a cover 15 and a proportional magnet 16. Chambers are formed in the slide bore 14 by means of ring-shaped widenings placed next to each other and embodied in the direction starting at the cover 15 and viewed in the direction toward the proportional magnet 16 as a first motor chamber 17, a return flow chamber 18, a second motor chamber 19 and in inflow chamber 21. A first motor connection B, a return connection R, a second motor connection A and an inflow connection P are associated to these chambers 17 to 21 in a corresponding manner. A valve seat 22, whose effective diameter is made less than the diameter of the slide bore 14, is embodied in the slide bore 14 in the area between the first motor chamber 17 and the return flow chamber 18 close to the latter, which valve seat 22 represents a part of the lowering element 11.

A pilot seat valve is arranged in the lowering element 11 as a blocking valve, whose seat valve body 23 is slidingly guided in the slide bore 14 and receives a pilot cone 24 in its interior. With its front face 26, which is stressed by a spring 25, the seat valve body 23 delimits a pressure chamber 27, whose pressure, together with the force of the spring 25, presses the seat valve body 23 against the valve seat 22. In the blocking position, the valve seat body 23 contacts the valve seat 22 with a seat edge 28, wherein the diameter of the seat edge 28 is less than the diameter of the slide bore 14. The seat valve body 23 is guided in the slide bore 14 by means of a shaft 29 and on this shaft 29 it has a first control edge 31, which is followed by precision control recesses 32 on the exterior circumference of the shaft 29. An annular chamber 33, to which an annular surface 34 on the seat valve body 23 is assigned, is enclosed in the slide bore 14 by the stepped embodiment of the seat valve body 23 between the notch-like precision control recesses 32 and the seat edge 28 of reduced. diameter. The cross section of the slide bore 14, reduced by this annular surface 34, results in a pressure face 35, whose size is determined by the effective seat edge 28. The shaft 29 is seated with sufficient play in the slide bore 14, so that the load pressure prevailing in the first motor chamber 17 can also be built up in the pressure chamber 27 and in the annular chamber 33 via the gaps acting as throttle points.

The pilot cone 24 arranged in the seat valve body 23 is designed in a pressure-compensated manner, to which end the diameters of its cone edge 36 and its shaft section 37 are embodied to be of the same size. The pilot cone 24 controls the connection from an annular chamber 38 to the return flow chamber 18 with its cone edge 36, wherein the annular chamber 38 has a connection with the pressure chamber 27 via a bore 39. By means of the long structure of the shaft element 37, which only has a little play, the pilot cone 24 seals the annular chamber 38 very well against a spring chamber 41, in which a pilot spring 42 is arranged, which presses the pilot cone 24 on its seat. The spring chamber 41 is connected with the return flow chamber 18 via conduits 43 arranged in the pilot cone 24, so that the pilot cone 24 is relieved of pressure on all sides.

An unblocking member 44 has been placed between the pilot blocking valve in the lowering element 11 and the proportional magnet 16, which is here designed as a longitudinal slide 45 slidingly arranged in the slide bore 14. The longitudinal slide 45 controls the connection between the inflow chamber 21 and the second motor chamber 19 with a second control edge 46, wherein notch-like precision control recesses 47 are also arranged on the second control edge 46. On its end located opposite the precision control recesses 47, the piston section 48 supporting the second control edge 46 has an auxiliary control edge 49, which controls the connection from the second motor chamber 19 to the return flow chamber 18. The inflow chamber 21 is blocked by the positive covering of the second control chamber 46 in the initial position of the longitudinal slide 45 represented, while the auxiliary control edge 49 relieves the second motor chamber 19 into the return flow chamber 18. The longitudinal slide 45 is furthermore pressure-compensated by its annular groove 51 in respect to the pressure in the inflow chamber 21. The two front faces of the longitudinal slide 45 are connected with each other via compensating bores 52. On its front face facing the proportional magnet 16, the longitudinal slide 45 rests directly against a tappet 53, actuated by the armature, of the magnet 16. An extension 54 is formed on the oppositely located front face of the longitudinal slide, which protrudes into the return flow chamber 18 and which forms a transfer bolt 55 with its trailing end, which rests against the pilot cone 24. The extension 54 additionally forms a transfer shoulder 56, which is associated with the seat valve body 23 and whose contact surface is located at a distance from the end face of the transfer bolt 55.

The functioning of the first control device 10 will be explained as follows:

With the proportional magnet 16 not excited, the lowering element 11 and the lifting element 12 take up the initial position represented, which corresponds to the neutral position. In this case the inflow connection P is hydraulically blocked by the longitudinal slide 45, since the second control edge 46 blocks the connection to the motor connection A. On the other side the motor connection A is relieved via the auxiliary control edge 49 into the return flow chamber 18, so that no pressure can build up in it, even in case of a possibly occurring leak flow. As a rule, the servo motor is connected with its load side to the motor connection B, wherein the pressure in the first motor chamber 17 can also be built up in the pressure chamber 27 and in the annular chamber 38 via the gap formed by the shaft 29. On a remaining difference surface, which corresponds to the pressure surface 35, the seat valve body 23 is pressed on the valve seat 22 by the pressure in the pressure chamber 27 and by the force of the spring 25, and in the process provides a sealing of the motor connection B with few leaks. The load pressure in the motor connection B can also be built up in the annular chamber 38 from the pressure chamber 27 via the bore 39 where, however, it is dependably sealed in respect to the return flow chamber 18 by means of the cone edge 36 and the long shaft of the pilot cone 24. In the initial position represented, the pilot spring 42 maintains the pilot cone 24 on its seat, and via the transfer bolt 55 maintains the longitudinal slide 45 in the position represented, in which it rests against the tappet 53 of the proportional magnet 16.

If the proportional magnet 16 is now excited, and in the process the longitudinal slide 45 is deflected toward the left into the work position, it first opens the pilot cone 24 by means of the transfer bolt 55, by means of which the pressure chamber 27 is relieved into the return flow chamber 18. Less pressure medium can flow into the pressure chamber 27 via the gap of the shaft 29 acting as a throttle point, than flows off via the pilot cone 24, so that the pressure in the pressure chamber 27 is relieved. A pressure possibly still remaining in the annular chamber 33 acts on the annular surface 34 and pushes the seat valve body 23 toward the left against the force of the spring 25, so that this annular chamber 33 is relieved into the return flow chamber 18 via the seat edge 28. In this way the seat valve body 23 is hydraulically unblocked in this way, and during the left movement of the longitudinal slide 45 is now taken along by the transfer shoulder 56, which has been placed against the front face of the seat valve body 23. Now the precision control recesses 32 on the seat valve body 23 first open and connect the motor connection B with the return flow chamber 18, and thereafter—with negative covering—the precision control recesses 47 on the longitudinal slide 45 open the connection from the motor connection A to the inflow chamber 21. Thus the volume flows, from B to R on the one side, and on the other from P to A, are proportionally controlled by means of these precision control recesses. Therefore the switching capacity of the control device 10 is essentially a function of those pressure drops which are effective on the control edges 31, or respectively 46. It is relatively simple for the lifting element 12 to keep the pressure drop via the second control edge 46 relatively small and constant. This can be achieved, for example, by means of a pressure scale, through which a load pressure-compensated volume flow can be controlled.

The switching load is relatively low at the lowering element 11 when the load pressure is applied at the motor connection B. Because of occurring flow forces, the volume flow flowing through the lowering element 11 tries to move the seat valve body 23 toward the right, i.e. to pull it shut. This closing force is all the greater, the greater the volume flow and the pressure drop are. By means of an appropriate layout of the seating angle 58 at the valve seat 22 and of the effective seat diameter it can now be achieved that the pressure is built up in the annular chamber 33. This built-up pressure acts in the annular chamber 33 on an annular surface 34 of the seat valve body 23, and therefore counter to the flow force. By means of this it is possible to achieve a considerable flow force reduction, which leads to an essential increase in the switching capacity even at high load pressures. With the present control device 10 the seat valve body 23 is mechanically taken along after unblocking of the blocking valve, such as is the case per se with a slide device, so that stable functioning can be achieved. In particular, in contrast to hydraulically actuated locking blocks, wherein instabilities occur in case of pulling loads, it is possible by means of the mechanical coupling of the seat valve body 23 and the longitudinal slide 45 to achieve stable work conditions even with unfavorable operating conditions. Because of the immediate, direct actuation of the longitudinal slide 45 by the proportional magnet 16, a very simple, cost-effective and compact construction results, which can be advantageously used in particular with smaller switching capacities. Because of the flow force reduction, it is possible in spite of the direct actuation to achieve a relatively high switching capacity, even with relatively small sized proportional magnets. In the working positions the proportional magnet 16 pushes the longitudinal slide 45 with the seat valve body 23 resting against it to the left against the force of the spring 25, wherein the size of the stroke is proportional to the size of the magnetic force. The precision control recesses 32 and 47 are actuated corresponding to the amount of deflection, so that the two volume flows from B to R, or respectively P to A, are controlled proportionally to the size of the electrical input signal at the proportional magnet 16.

Figure 2:
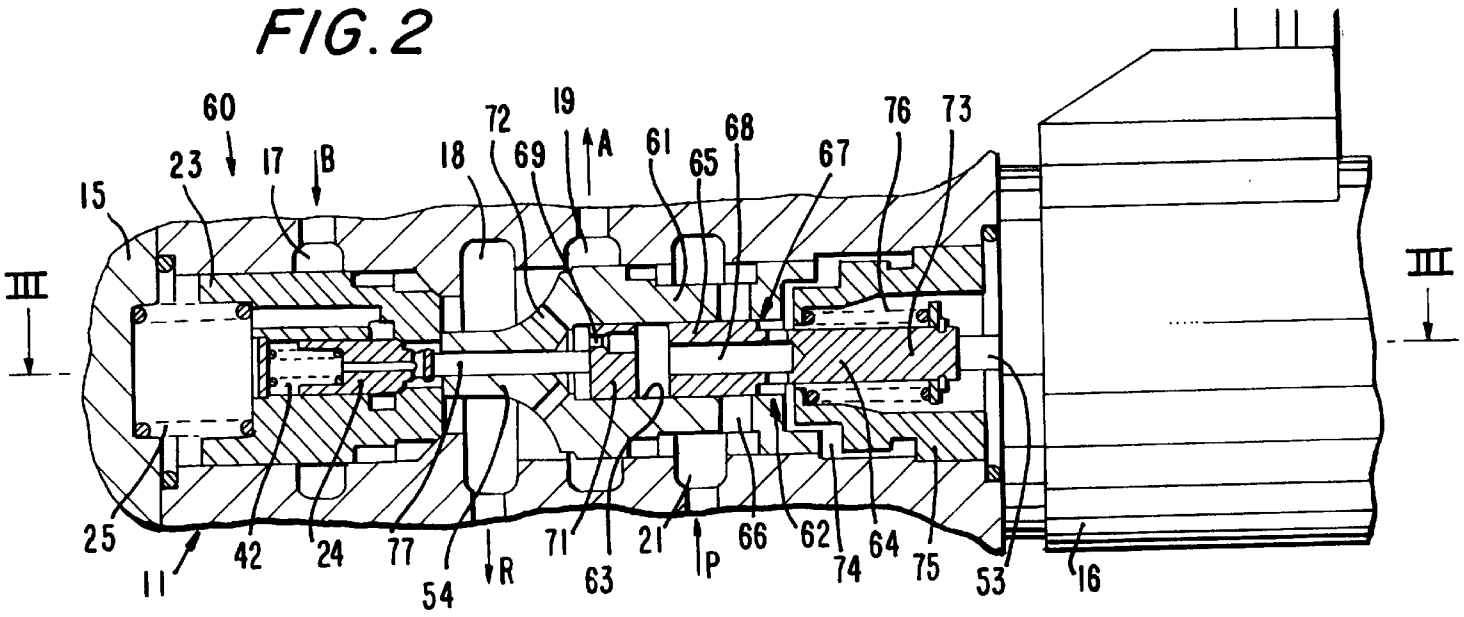
FIG. 2 shows a longitudinal section through a second control device in a simplified representation.

FIG. 2 shows a longitudinal section through a second control device 60, which differs from that in FIG. 1 in the following way, wherein the same reference numerals were used for the same components.

The lowering element 11, the proportional magnet 16 and the slide bore 14 with its chambers remain unchanged in the second control device 60, but the lifting element 12 has a different longitudinal slide 61, which can be actuated by the proportional magnet 16 via a hydraulic sequence control device 62. In this way the second control device 60 can achieve higher switching capacities in comparison with the first control device 10. Here, the longitudinal slide 61 is embodied to be hollow, and receives a pilot slide 64 in a blind bore-like longitudinal bore 63, which is arranged centered and open toward the proportional magnet 16. The pilot slide 64 is sealingly and slidingly guided by means of a piston section 65 in the longitudinal bore 63 and, together with the radial bore 66 in the longitudinal slide 61, constitutes an adjustable throttle point 67, which is placed into a control line 68 of the sequence control device 62. This control line 68 leads from the inflow chamber 21 via the radial bores 66, the adjustable throttle point 67, the hollowly embodied pilot slide 64, a portion of the longitudinal bore 63, a throttle 62 in an unblocking piston 71 and via oblique bores 72 in the longitudinal slide 61 into the return flow chamber 18. The pilot slide 64 projects with a cylindrical section 73 into a control chamber 74 formed in the slide bore 14 between the longitudinal slide 61 and the proportional magnet 16. An adjusting screw 75, which can be axially adjusted by means of a worm, not represented in detail, is arranged in this control chamber 74, on which a regulating spring 76, which is fixed in place on the housing, is supported, whose other end is supported on the cylindrical section 73 and maintains the pilot slide 64 in contact against the tappet 53 of the proportional magnet 16.

The unblocking piston 71 is slidingly guided at the inner end of the longitudinal bore 63 of the pilot slide 64 and is in operative connection with a transfer pin 77. This transfer pin 77 is slidingly seated in the extension 54 and rests against the pilot cone 24 of the blocking valve in the initial position of the control device 60. It is particularly useful here that the pilot slide 64 with its piston section 65 and the unblocking piston 71 have the same exterior diameter, so that they can be slidingly arranged in a single longitudinal bore 63. In this way the longitudinal slide 61 makes a one-piece construction possible because of its longitudinal bore 63 embodied in the manner of a blind bore, which is particularly advantageous to produce in connection with production technology.

Figure 3:
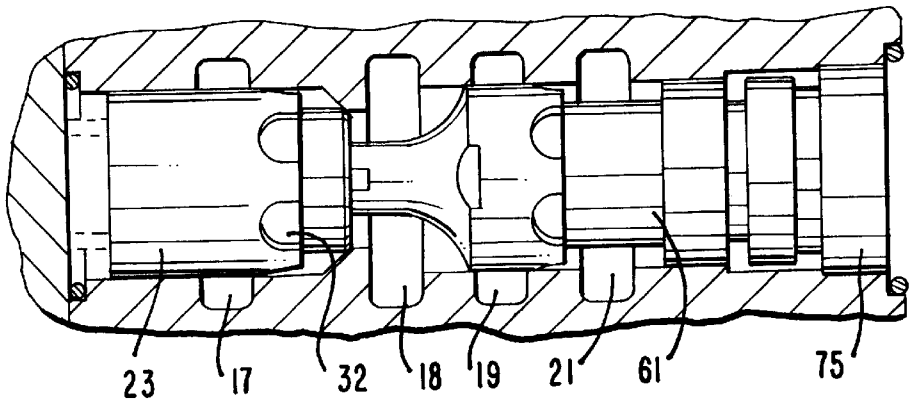
FIG. 3 shows a top view of a portion of the second control device in accordance with FIG. 2.

FIG. 3 shows a partial longitudinal section along III—III in FIG. 2, wherein the seat valve body 23, the longitudinal slide 61 and the adjusting screw 75 are shown in a top view.

In principle, the functioning of the second control device 60 corresponds to that of the first control device 10 in accordance with FIG. 1, however, greater switching capacities can be achieved because of the hydraulic sequence control device 62.

In the represented initial position of the second control device 60, which corresponds to a neutral position, the first motor chamber 17 as well as the inflow chamber 21 are hydraulically blocked. In the initial position, the pilot slide 64 is maintained resting against the tappet 53 by the regulating spring 76, and thus in a position fixed on the housing. The axial position of the longitudinal slide 61, which just closes the adjustable throttle point 67, is also fixed in place in this way.

When actuating the second control device 60, the proportional magnet 16 merely needs to act against the force of the regulating spring 76, since the pilot slide 64 is pressure-compensated on all sides. When the pilot slide opens the adjustable throttle point 67, a control oil flow is formed via the control line 68, wherein the pressure built up at the throttle 69 actuates the unblocking piston 71 and thereby opens the pilot cone 24, so that the blocking valve in the lowering element 11 is unblocked. Otherwise the longitudinal slide 61 follows the stroke of the pilot slide 64, wherein an intermediate pressure builds up in the control chamber 74 for actuating the longitudinal slide 61 and amplifies the magnetic force. In the process, the longitudinal slide 61 and the pilot slide 64 work together in a manner known per se in the form of a hydraulic sequence control device. The prestress of the regulating spring 76 can be changed with the aid of the adjusting screw 75, and the position of the characteristic valve curve can be set with this.

Figure 4:
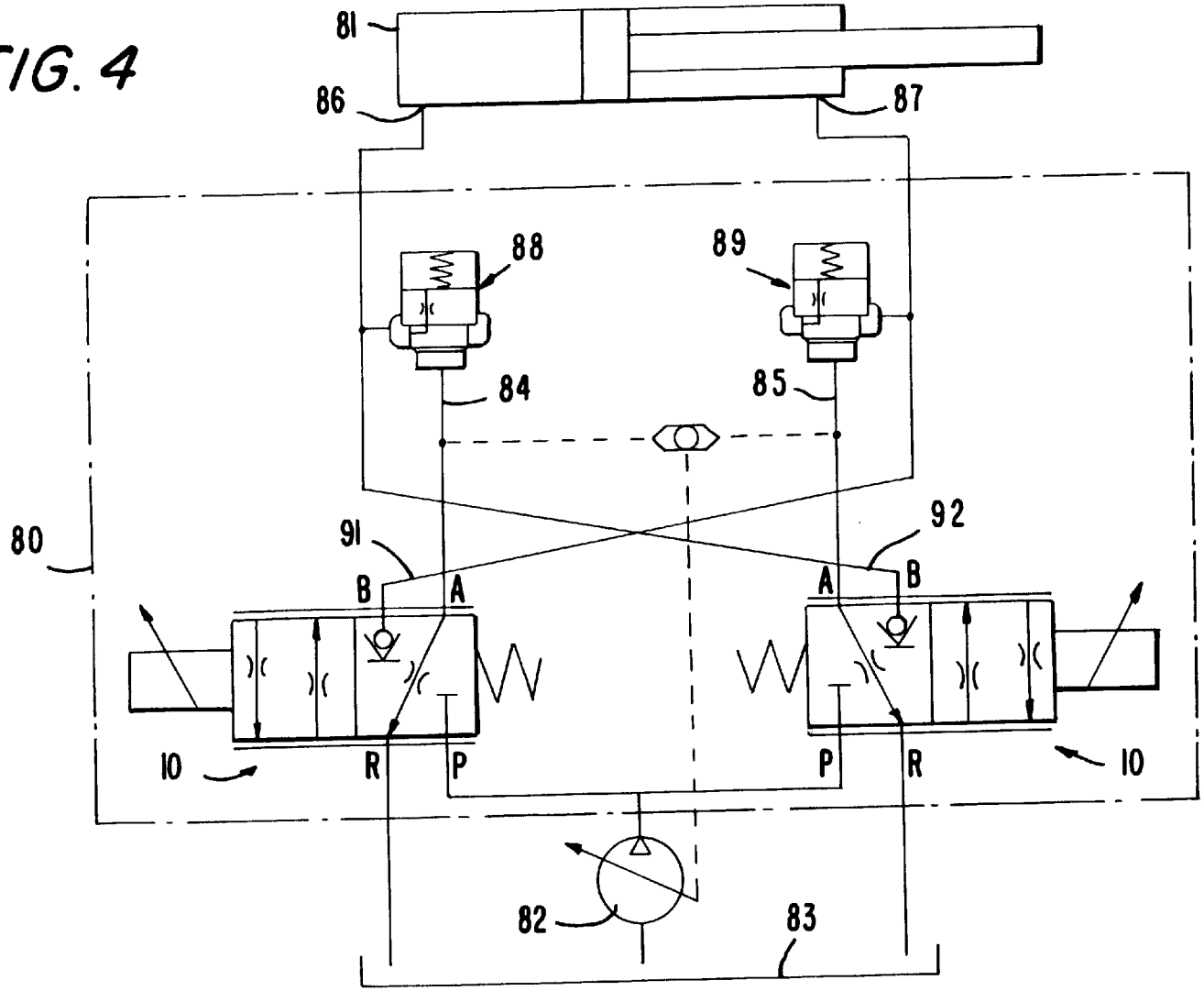
FIG. 4 shows a circuit arrangement with the first, or respectively second control device in accordance with FIG. 1, or respectively 2.

FIG. 4 shows a circuit in a simplified representation, wherein two first control devices 10 of FIG. 1 have been arranged to form a directional control valve 80 for a double-acting servo motor. In this case the two P connections of both control devices 10 are connected parallel to a control pump 82, while their two connections R are relieved into a tank 83. An inflow line 84, or respectively 85, leads from each connection A of each control device 10 to one of the consumer connections 86, or respectively 87, on the servo motor 81. Here each inflow line 84, 85 is conducted over a check valve 88, or respectively 89, which protects the load. The two connections B at each control device 10 are respectively connected by means of an outflow line 91, or respectively 92, with the respectively other consumer connection 87, or respectively 86. A load pressure signal is picked up at the inflow lines 84, 85 and reported to the control pump 82. A 3-position valve has been realized by means of the control valve 80, which securely seals the servo motor 91 when the control devices 10 are not actuated. To keep the leakage low, the consumer connection 86 is securely blocked on the one side by the check valve 88, and on the other side by the blocking valve in the lowering element 11 of the right control device 10. Similar is true for the other consumer connection 87. By actuating the left control device 10, the servo motor 81 can be operated in one direction with the piston rod extending, while by actuating the right control device the servo motor 81 can be controlled in the other direction with the piston rod retracting, wherein a proportional operation is achieved. By means of processing the load pressure signal in the control pump 82 it is possible to keep the pressure drop constant in the lifting element 12 via the second control edge 46, so that a load-compensated volume flow control becomes possible.

Changes in the exemplary embodiments represented are of course possible without departing from the scope of the invention. Although the pilot blocking valve in the control device is particularly advantageous, it is also possible to employ a directly controlled blocking valve having a blocking valve body which has been pressure-relieved to a large extent. The continuous slide bore can also be designed in such a way that in the area of the lowering element it has a slightly larger diameter than in the lifting element, so that the interior diameter of the valve seat 22 approximately corresponds to the diameter of the slide bore. Also, in the wiring in accordance with FIG. 4 it is possible to use the second control devices 60 in place of the first control devices 10. In this case the regulating valve 80 can also be embodied in such a way that it has four operating positions. A constant pump with a pressure scale is also conceivable in place of the control pump 82.

What is claimed is:

1. An electro-hydraulic control device for a hydraulic servo motor for controlling a volume flow, having a blocking valve arranged in a housing, whose movable seat valve body is inserted into a connection between a first motor chamber and a return flow chamber and in the process secures the motor chamber, and having a proportional magnet with an armature-actuated tappet for actuating the blocking valve, and having a longitudinally movable unblocking member, which is separated from the blocking valve and slidingly guided in the housing, which is inserted into the operational connection between the tappet of the proportional magnet and the blocking valve, characterized in that the seat valve body (23), the unblocking member (44) and the tappet (53) of the proportional magnet (16) are arranged coaxially in respect to each other, and the unblocking member is embodied as a longitudinal slide (45, 61) which, with one control edge (46), controls the connection between an inflow chamber (21) and a second motor chamber (19), wherein the latter is arranged in the slide bore (14) receiving the longitudinal slide (45, 61) next to the return flow chamber (18), and that the longitudinal slide (45, 61) essentially has the same exterior diameter as the seat valve body (23), and that upon actuation by the proportional magnet (16), both connections are opened or closed in the same direction.

2. The electro-hydraulic control device in accordance with claim 1, characterized in that the blocking valve is a pilot valve, the seat valve body (23) receives a pilot member (24) and the pilot member (24) is opened by the longitudinal slide (45,61) via a transfer bolt (55,77).

3. The electro-hydraulic control device in accordance with claim 2, characterized in that the pilot member is a pressure-compensated pilot cone (24).

4. The electro-hydraulic control device in accordance with claim 1, characterized in that the longitudinal slide (45) has notch-like precision regulating recesses (47) on said control edge (46).

5. The electro-hydraulic-control device in accordance with claim 1, characterized in that the longitudinal slide (61) can be actuated by the proportional magnet (16) via a hydraulic sequence control device (62) (FIG. 2).

6. The electro-hydraulic control device in accordance with claim 5, characterized in that the sequence control device (62) has a pilot slide (64), which can be actuated by the proportional magnet (16) against a regulating spring (76) and is arranged centered on the longitudinal slide (61) and slidingly guided.

7. The electro-hydraulic control device in accordance with claim 6, characterized in that the pilot slide (64) is embodied to be pressure-compensated.

8. The electro-hydraulic control device in accordance with claim 5, characterized in that an unblocking piston (71) is arranged in the longitudinal slide (61), which is used for unblocking the blocking valve in the lowering element (11) by means of a transfer bolt (77), which is slidingly guided in the longitudinal slide.

9.The electro-hydraulic control device in accordance with claim 8, characterized in that the control oil flow, which is used for the hydraulic sequence control device (62) and is conducted from the inflow chamber (21) to the return flow chamber (18), is conducted over a throttle (69) arranged in the unblocking piston (71).

10. The electro-hydraulic control device in accordance with claim 5, characterized in that the pilot slide (64) and the unblocking piston (71) have the same exterior diameter and are slidingly guided in the longitudinal slide (63) in the same longitudinal bore (63).

11. The electro-hydraulic control device in accordance with claim 5, characterized in that, with its front face facing the proportional magnet (16), the longitudinal slide (61) delimits a control chamber (74) in the slide bore (14), which chamber receives an adjusting screw (75), against which the regulating spring (76) is supported, fixed in place on the housing, which charges the pilot slide (64) against the magnetic force.

12. The electro-hydraulic control device in accordance with claim 5, characterized in that the control line (68) associated with the hydraulic sequence control device (62) is conducted through the hollow pilot slide (64), the longitudinal bore (63) and the unblocking piston (71), wherein the pressure is supplied to the control chamber (74) upstream of the throttle (69) and downstream of an adjustable throttling point (67) and drives the longitudinal slide.

13. The electro-hydraulic control device in accordance with claim 1, characterized in that the seat valve body (23) and the longitudinal slide (45,61) are guided in a continuous slide bore (14); the first motor chamber (17), the return flow chamber (18), the second motor chamber (19) and the inflow chamber (21) are formed by four widenings provided in the slide bore (14) and aranged spaced from each other in a direction toward the proportional magnet (16); the four chambers (17,18,19,21) are associated with a first motor connection (B), a return flow connection (R), a second motor connection (A) and an inflow connection (P) respectively; and a valve seat (22) having a diameter smaller than that of the slide bore (14), said valve seat (22) being associated with the seat valve body (23), is arranged in the slide bore (14) between the first motor chamber (17) and the return flow chamber (18).

14. The electro-hydraulic control device in accordance with claim 13, characterized in that the seat valve body (23) in the slide bore (14) bounds a pressure chamber (27), in which a spring (25) is arranged, and the seat valve body (23) is urged in a direction toward a blocking position by the spring (25) and a pressure in the pressure chamber (27) acting on a front face of the seat valve body (23) with a seat edge (28) thereof resting against the valve seat (22) fixed on the housing so as to form an annular chamber (33) upstream of the valve seat and bounded by the seat valve body, and a pressure in the annular chamber (33) urges the seat valve body in an opening direction via an associated annular surface (34), said annular chamber (33) being separated from the first motor chamber (17) by means of the control edge (31), in which regulating recesses (32) are provided around a circumference of the seat valve body.

15. The electro-hydraulic control device in accordance with claim 1, characterized in that the longitudinal slide (45,61) has an axially oriented extension (54) at an end of the longitudinal slide (45,61) facing away from the proportional magnet (16) and the axially oriented extension (54) protrudes into the return flow chamber (18), the extension (54) has a transfer shoulder (56) associated with the seat valve body (23) and the extension (54) has a transfer bolt (55,77) at an end of the extension (54).

16. The electro-hydraulic control device in accordance with claim 1, characterized in that the longitudinal slide (45) is directly operable by means of the armature tappet (53) and further comprising means for pressure compensating pressures present in the inflow chamber (21), the second motor chamber (19) and the return flow chamber (18).

17. The electro-hydraulic control device in accordance with claim 1, characterized in that the longitudinal slide (45) has a piston section (48) supporting said control edge (46) and an auxiliary control edge (49), which, in an initial position, relieves the second motor chamber (19) to the return flow chamber (18), and in an operating position blocks this connection.

* * * * *